United States Patent [19]

Bird

[11] 4,018,443

[45] Apr. 19, 1977

[54] SIMULATED HOCKEY GAME GOAL UNITS

[76] Inventor: David M. Bird, 60 Disamar Rd., Taunton, Mass. 02780

[22] Filed: May 7, 1975

[21] Appl. No.: 575,150

[52] U.S. Cl. ..... 273/85 R; 273/127 B

[51] Int. Cl.[2] ..... A63F 7/06

[58] Field of Search ..... 273/127 R, 127 B, 85 R, 273/118 R, 126 R; D230/4, 22; 43/58, 61, 62, 67

[56] References Cited

UNITED STATES PATENTS

| | | | |
|---|---|---|---|
| 2,387,811 | 10/1945 | Smith | 43/61 |
| 3,228,688 | 1/1966 | Dennison | 273/85 R |
| 3,834,063 | 11/1974 | Souza et al. | 43/61 |

FOREIGN PATENTS OR APPLICATIONS

| | | | |
|---|---|---|---|
| 2,034,663 | 5/1971 | Germany | 273/127 R |

*Primary Examiner*—Richard C. Pinkham
*Assistant Examiner*—T. Brown

[57] ABSTRACT

A game apparatus includes a goal having a top, support members extending from the top to the playing surface, and enclosure means intermediate the top and the playing surface with a gap in those means defining a goal mouth. The goal top is formed as a rigid unit for supporting the weight of a player and is spaced from the playing surface by a distance which permits the player to sit on the top with knees bent and feet on the playing surface.

11 Claims, 2 Drawing Figures

SIMULATED HOCKEY GAME GOAL UNITS

BACKGROUND OF THE INVENTION

This invention relates to a goal unit and other portions of a game apparatus that can be used to play within a small area a game that simulates a large-area game (e.g., hockey).

Various popular games or sports (e.g., hockey, soccer, etc.) require specialized equipment and a large playing area. A number of derivative games, based upon these sports, have been proposed, but each either requires a large area and/or is too dangerous for indoor use (e.g., street hockey) or is reduced to a board game with little flavor of the original sport and requiring few skills in common with the original sport.

SUMMARY OF THE INVENTION

In view of the foregoing, it is a principal object of the present invention to provide equipment whereby large-area games can be simulated in a relatively small area, while retaining various of the offensive and defensive skills required by the sport. It is a further object to provide such equipment which facilitates a game of such limited proportions, and such controlled physical activity, that the game can be played either indoors or out.

To achieve these and other objects as shall further appear hereinafter, according to the invention there is provided a game goal unit for placement on a playing surface as a target for a projectile shot at the goal unit. The unit includes a top, members extending from the top to the playing surface for supporting the top, and enclosure means disposed between the top and the playing surface, a gap in those enclosure means defining a goal mouth. The top is formed as a rigid unit for supporting the weight of a player and is spaced from the playing surface by distance which permits the player to sit on the top with knees bent and with feet on the playing surface. Preferably, the top is spaced from the playing surface by a distance of about 12 inches; the goal mouth has a width of about 14 inches, permitting a player seated on the top to place his feet on the playing surface of opposite sides of the goal mouth; the upper surface of the top is contoured, whereby the surface provides a comfortable seat for the player; the supports are received in sockets in the top, whereby the unit can be disassembled by removal of the supports from the sockets; and the apparatus is designed to simulate the game of ice hockey with the apparatus including a pair of goal units as described above, a projectile having a flat surface for sliding on the playing surface, and a pair of sticks for striking the projectile. The game apparatus also preferably includes barrier means which enclose a playing area, thereby limiting the travel of the projectile (e.g., the puck) on misdirected shots.

BRIEF DESCRIPTION OF THE DRAWINGS

Other objects, features, and advantages of the invention will appear from the following description of a particular preferred embodiment, which is illustrated in the accompanying drawings. In the drawings.

DETAILED DESCRIPTION OF A PARTICULAR PREFERRED EMBODIMENT

Figure 1:
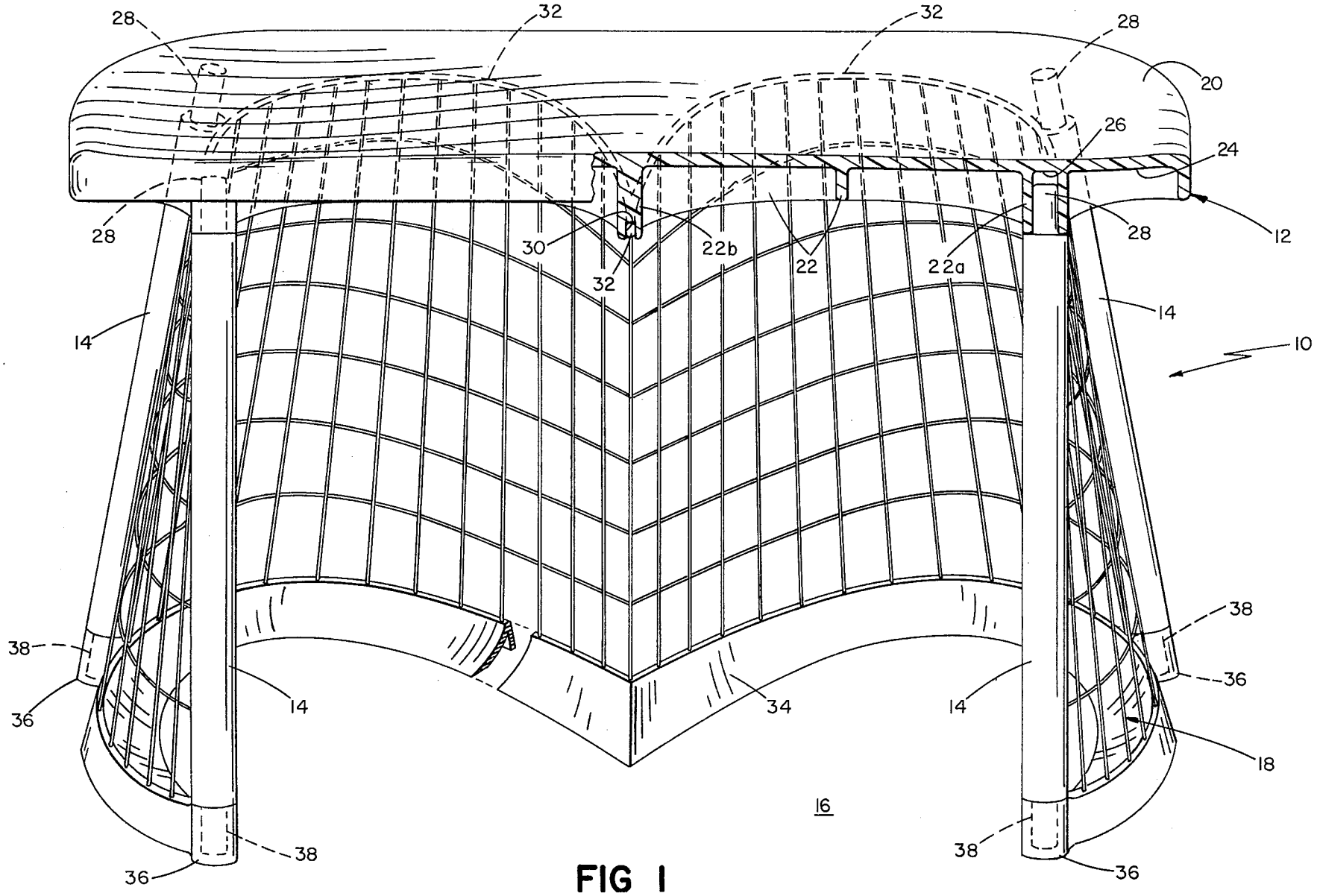
FIG. 1 is a perspective view, partially broken away, of a goal unit constructed in accordance with the present invention.

FIG. 1 shows a goal unit 10 consisting of a rigid unitary top 12, support members 14 extending between the top 12 and a playing surface 16, and enclosure means in the form of a net 18. Each of these members is preferably formed from a thermoplastic material (e.g., "Mylek"). The top 12 has a contoured upper surface 20 for receiving a player in a sitting position thereupon and is provided with a series of reinforcing ribs 22 integral with its under surface 24. In the preferred embodiment illustrated, the top 12 is approximately 17 inches wide and 10 inches deep. At spaced-apart locations, reinforcing ribs **22*a* are so formed as to provide a socket 26 for receiving a reduced diameter portion 28 of the support members 14. Other reinforcing ribs 22*b* define a channel 30 which receives a bead 32 molded integrally with the net 18** for supporting the net.

The net 18 is integral at its bottom with a base and puck-deflector 34. Sockets 36, integral with puck-deflector 34, receive reduced diameter portions 38 at the opposite ends of support members 14. The mesh size of the net 18 is chosen to be smaller than the relevant dimensions of any projectile which might be used with the goal (e.g., a 2-inch diameter Mylek puck). The opening in the net 18 at the front of the goal unit 10 defines a goal mouth approximately 14 inches wide and 12 inches high. The base and puck-deflector 34 prevents a puck from passing beneath the net 18 and out of the goal unit 10 and also serves as a rigid connector between the sockets 36, thereby adding stability to the unit 10 when it bears the weight of a player.

Figure 2:
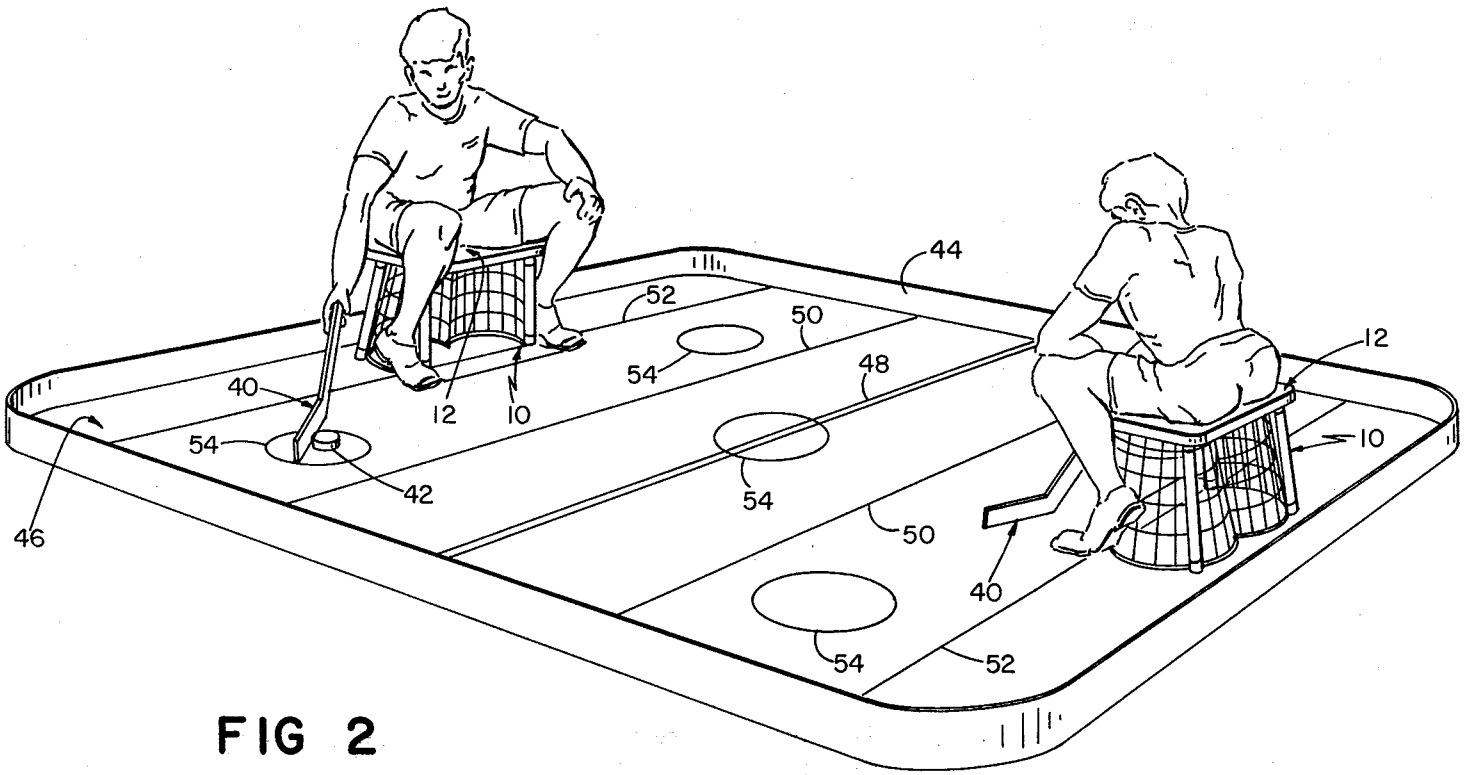
FIG 2 is a perspective view of the game apparatus according to the invention in actual use.

FIG. 2 shows a game apparatus comprising a pair of goal units 10, each having a player seated upon the top 12; a pair of "hockey sticks" 40 (preferably of Mylek with a 6-inch blade and a 12-inch handle); a 2-inch diameter hollow Mylek puck 42; and a generally rectangular barrier 44 defining the play area and enclosing the playing area 46. The barrier 44 is preferably formed from a plastic material and the apparatus can include any conventional form of supports (not shown) if needed to maintain the barrier 44 in an upright orientation. The playing area 46 can be marked with a red line 48, blue lines 50, goal lines 52, and face-off circles 54. While not required, these markings do facilitate the play of various games and assist in rendering the entire apparatus a better simulation of a hockey rink. While a playing surface may be provided with the markings permanently affixed thereupon, the apparatus may include indicia (e.g., rolls of pressure sensitive adhesive tape of various color backings) that may be applied to any playing surface (e.g., a floor, a driveway, etc.). The provision of such replaceable indicia also renders a single game apparatus adaptable to the simulation of a variety of games requiring different lines and other markings (e.g., hockey, soccer, etc.)

For use indoors, the barrier 44 may not be needed. If, for example, a room is of suitable size, its walls may serve as a barrier. Additionally, no matter what sport is to be simulated with the apparatus, when used indoors the projectile is preferrably of hollow, perforate form so as to limit the speed which the projectile can attain.

While a particular embodiment of the present invention has been illustrated in the accompanying drawing and described in detail herein, other embodiments are within the scope of the invention and the following claims.

I claim:

1. A game apparatus comprising a goal unit in combination with a projectile of predetermined size, said goal unit being adapted for placement on a playing surface as a target for receiving said projectile of said predetermined size projected at said goal unit, said goal unit including a top, members extending from said top to said playing surface for supporting said top, and enclosure means disposed between said top and said playing surface, a continuously open gap in said enclosure means defining a goal mouth, said top being formed as a substantially flat-surface rigid unit for supporting the weight of a player and being spaced from said playing surface by a distance which permits a player to sit on said top with knees bent and feet on said playing surface.

2. The game apparatus of claim 1 wherein said top is spaced from said playing surface by a distance of about 12 inches.

3. The game apparatus of claim 1 wherein said enclosure means comprise a net with a mesh size smaller than said predetermined projectile size.

4. The game apparatus of claim 1 wherein said goal mouth has a width which permits a player seated on said top to place his feet on said playing surface at opposite sides of said goal unit with said goal mouth therebetween.

5. The game apparatus of claim 4 wherein said goal mouth width is about 14 inches.

6. The game apparatus of claim 5 wherein said goal mouth has a height of about 12 inches.

7. The game apparatus of claim 1 wherein the upper surface of said top is contoured, whereby said surface provides a comfortable seat for said player.

8. The game apparatus of claim 1 wherein there are at least four support members.

9. The game apparatus of claim 1 wherein said top includes sockets for receiving said support members, whereby said unit can be diassembled by removal of said support members from said sockets.

10. The game apparatus of claim 1 comprising a pair of goal units, and a pair of sticks for striking said projectile.

11. The game apparatus of claim 10 further including barrier means enclosing a playing area, said goal units being disposed within said barrier means.

* * * * *